US008568020B2

(12) United States Patent
Forsey et al.

(10) Patent No.: US 8,568,020 B2
(45) Date of Patent: Oct. 29, 2013

(54) TIMEPIECE INCLUDING A PIVOTING MEMBER

(75) Inventors: Stephen Forsey, Les Brenets (CH); Robert Greubel, Lignieres (CH)

(73) Assignee: CompliTime SA, La Chaux-de-Fonds (CH)

( * ) Notice: Subject to any disclaimer, the term of this patent is extended or adjusted under 35 U.S.C. 154(b) by 208 days.

(21) Appl. No.: 13/141,876

(22) PCT Filed: Dec. 16, 2009

(86) PCT No.: PCT/EP2009/067261
§ 371 (c)(1),
(2), (4) Date: Jun. 23, 2011

(87) PCT Pub. No.: WO2010/072629
PCT Pub. Date: Jul. 1, 2010

(65) Prior Publication Data

US 2011/0273969 A1 Nov. 10, 2011

(30) Foreign Application Priority Data

Dec. 24, 2008 (CH) ..... 2020/08

(51) Int. Cl.
*G04B 29/00* (2006.01)

(52) U.S. Cl.
USPC ..... 368/324

(58) Field of Classification Search
USPC ..... 368/324–326, 322; 384/492, 625
See application file for complete search history.

(56) References Cited

U.S. PATENT DOCUMENTS

| | | | | |
|---|---|---|---|---|
| 5,515,607 | A | 5/1996 | Ikegami | |
| 6,472,062 | B1 * | 10/2002 | Neerinck et al. | 428/336 |
| 7,965,585 | B2 * | 6/2011 | Schiesser | 368/269 |
| 8,167,481 | B2 * | 5/2012 | Takeuchi et al. | 368/324 |
| 8,174,936 | B2 * | 5/2012 | Papi | 368/75 |
| 8,210,739 | B2 * | 7/2012 | Greubel et al. | 368/127 |
| 8,317,391 | B2 * | 11/2012 | Conus et al. | 368/326 |
| 2002/0114225 | A1 | 8/2002 | Damasko | |
| 2011/0044141 | A1 * | 2/2011 | Greubel et al. | 368/324 |

FOREIGN PATENT DOCUMENTS

| | | | |
|---|---|---|---|
| DE | 70 00 616 | U | 4/1970 |
| EP | 0 732 635 | A1 | 9/1996 |
| EP | 1 622 826 | B1 | 6/2007 |
| EP | 1 978 421 | A | 10/2008 |
| GB | 2 062 909 | A | 5/1981 |
| JP | 9 211149 | A | 8/1997 |

OTHER PUBLICATIONS

International Search Report, dated Mar. 7, 2010, from corresponding PCT application.

* cited by examiner

*Primary Examiner* — Sean Kayes
(74) *Attorney, Agent, or Firm* — Young & Thompson

(57) ABSTRACT

A timepiece includes a frame (1*a*, 1*b*) and a gear pivotably mounted on the frame (1*a*, 1*b*) via at least one pivoting member (5*a*, 5*b*) which includes a bearing and a pivot inserted in the bearing, at least the contact surfaces of the bearing and the pivot being made from at least one material with an intrinsically low friction coefficient and a low wear rate, the gear including at least one plate (2*a*, 2*b*) provided with a first hole (3*a*, 3*b*). The pivoting member includes a first plate (6*a*, 6*b*) provided with a second hole (8*a*, 8*b*) and forming the bearing, and a second plate (7*a*, 7*b*) provided with a small rod (9*a*, 9*b*) inserted in the first and second holes and forming the pivot, one of the first (6*a*, 6*b*) and second (7*a*, 7*b*) plates being rigidly connected to the gear and the other to the frame (1*a*, 1*b*).

11 Claims, 5 Drawing Sheets

TIMEPIECE INCLUDING A PIVOTING MEMBER

TECHNICAL FIELD

The present invention relates to a timepiece comprising a frame and a wheel pivotably mounted on said frame using at least one pivoting member that comprises a bearing and a pivot engaged in said bearing, the bearing and the pivot having at least their contact surfaces made from at least one material intrinsically having a low coefficient of friction and a low wear rate, the wheel including at least one board provided with a first hole. The pivoting member could alternately be applied to other mobile pieces of the timepiece, such as the pallet of the escapement, for example.

BACKGROUND OF THE INVENTION

Generally, a wheel pivotably mounted on a frame includes an arbor provided at both ends with pivots, each engaged in a bearing. Pivoting members formed by a bearing and a pivot are traditionally used to ensure axial and radial positioning of the rotating pieces present in the clockwork movements.

The pivot is generally made from steel and the bearing is for example made of brass, bronze, or ruby, the pairs of materials being chosen so that the frictional torque between the bearing and the pivot is as low and constant as possible.

However, pivoting members made from these pairs of materials are not always fully satisfactory regarding the value of the frictional torque and the wear obtained. They require the addition of a lubricant, inserted between the bearing and the pivot, which tends to deteriorate with time.

According to other methods described for example in documents U.S. Pat. No. 5,515,607, JP 09 211149, and DE 70 00 616, it is possible to make a wheel forming a single piece with the pivot. Such wheels comprising an integrated pivot are not the subject-matter of the present invention.

One aim of the present invention is to be able to use, in a timepiece, pivoting members whereof the contact surfaces are made from materials intrinsically having a low coefficient of friction and a low wear rate, i.e. not requiring such an addition of lubricant. This is the case in particular for bearings and pivots whereof the contact surfaces are made from diamond, another material, or a mixture of materials whereof the coefficient of friction is below 0.10. Unfortunately, such pieces are extremely difficult to manufacture using the regular machining techniques. They can for example be obtained by the method described in patent EP 1 622 826.

In particular, it is extremely difficult to product pieces as complex as a wheel arbor using the traditional methods. For example, it is extremely difficult to cut or assemble diamond pieces by riveting.

Another aim of the present invention is to propose a timepiece whereof the elements made from materials intrinsically having very low coefficients of friction and a low wear rate, i.e. not requiring the addition of lubricant, can easily be assembled.

BRIEF DESCRIPTION OF THE INVENTION

To that end, and according to the present invention, a timepiece is proposed comprising a frame and a wheel pivotably mounted on said frame using at least one pivoting member that comprises a bearing and a pivot engaged in said bearing, the bearing and the pivot having at least their contact surfaces made from at least one material intrinsically having a low coefficient of friction and a low wear rate, i.e. not requiring the addition of a lubricant, the wheel having at least one board provided with a first hole. According to the invention, said pivoting member comprises a first plate provided with a second hole and forming the bearing, and a second plate provided with a pivot-shank engaged in said first and second holes, and forming the pivot, said first and second plates being made integral one with the wheel, the other with the frame.

According to alternative embodiments, the second plate to form the pivot can comprise a planar element from which a cylindrical element forming the pivot-shank protrudes, the two elements being made in a single piece, or a planar element and a cylindrical element, forming the pivot-shank, separate.

According to the alternatives, the second plate can comprise, on the side opposite the pivot-shank, a shaft made integral with the second plate and the frame. Said shaft can be mounted passing through said second plate and in said pivot-shank.

According to the alternatives, the board provided with the first hole and the first plate, provided with the second hole can be merged, said first and second holes then being merged. However, regarding the second plate provided with a pivot-shank forming the pivot, said second plate is always separate from the board of the wheel, provided with the first hole, so that the pivot is never integrated into said wheel.

According to the alternatives, the wheel can include two boards provided with a first hole and made integral in rotation, each board respectively being pivotably mounted in the frame using said pivoting member. To be made integral in rotation, said boards can comprise, around their first respective hole, a metal ring. In another embodiment, said boards can respectively comprise complementary assembling means, such as lugs, arranged to cooperate together and make said boards integral in rotation.

In the alternatives where the wheel has two boards, the shaft provided on the second plate of the pivoting members can be mounted passing through the second plate and in the pivot-shank of the pivoting member of each board of the wheel.

Preferably, the material intrinsically having a low coefficient of friction and a low wear rate, constituting at least the contact surfaces of the bearing and the pivot, is diamond.

BRIEF DESCRIPTION OF THE DRAWINGS

Other features of the present invention will appear more clearly upon reading the following description, done in reference to the appended drawings, in which.

DETAILED DESCRIPTION OF THE INVENTION

In this description, a material intrinsically having a low coefficient of friction and a low wear rate is any material ensuring its own lubrication, without the help of an external lubricant. Preferably, this coefficient of friction is less than or equal to 0.1. Furthermore, such a material must be hard enough to have a very low wear rate. Preferably, said material has a hardness greater than or equal to 9 on the Mohs scale. Preferably, said material is diamond. Any other material having a coefficient of friction and a wear rate equivalent to those of diamond can be used. Likewise, it is possible to use diamond with another material, or any other mixture of materials having a coefficient of friction and a wear rate equivalent to those of diamond alone.

In this description, at least the contact surfaces between the different elements of the timepiece, with the exception of the frame, are made from at least one material intrinsically having a low coefficient of friction and a low wear rate. The elements can also be made entirely from a material intrinsically having a low coefficient of friction and a low wear rate. The frame or only the surface thereof can be made from at least one material intrinsically having a low coefficient of friction and a low wear rate, or any other material.

Figure 2:
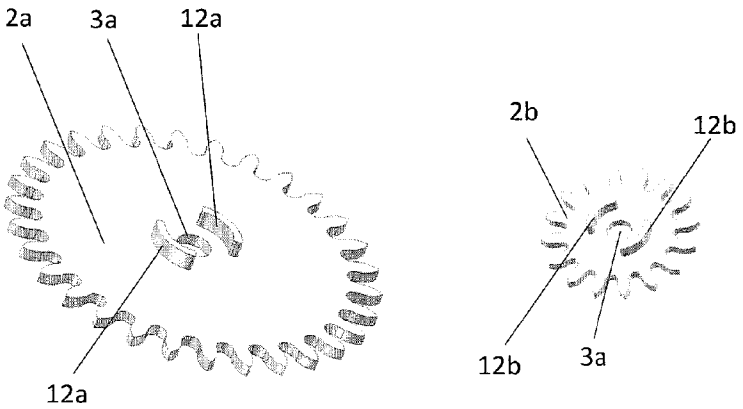
FIGS. 1 and 2 are respectively a cross-sectional view of a first alternative of the invention and a perspective view of the wheel.
Figure 1:
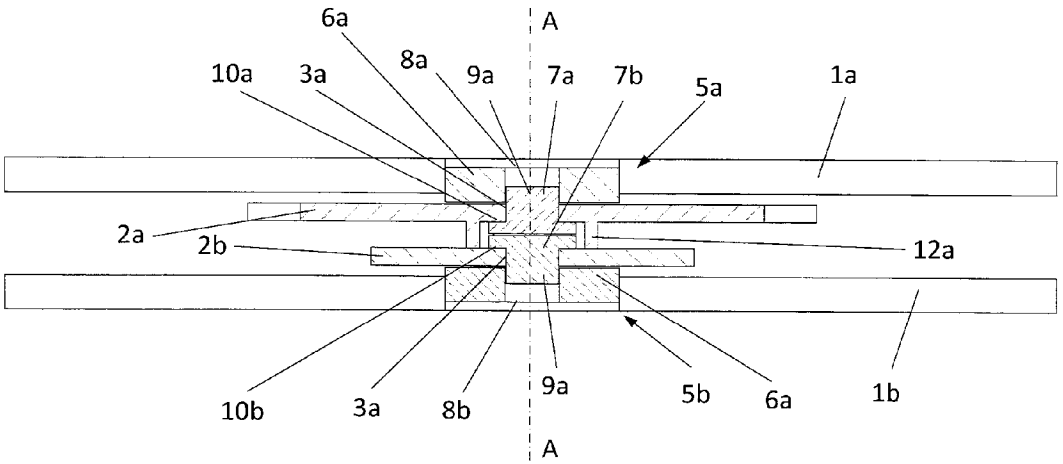

FIGS. 1 and 2 show a first alternative of a timepiece comprising a metal frame formed by a bridge 1*a* and a bottom plate 1*b*, and a wheel having a first board 2*a* provided with a toothing and a hole 3*a*, and a second board 2*b* provided with a toothing and a hole 3*b*. The boards 2*a*, 2*b* are made from diamond, for example by CVD.

The wheel is pivotably mounted around an axis AA on the bridge 1*a* and the bottom plate 1*b* using two pivoting members 5*a* and 5*b*, which each respectively comprise a bearing and a pivot engaged in their respective bearing.

According to the invention, each bearing is formed by a first plate 6*a*, 6*b* provided with a hole 8*a*, 8*b*, made from diamond, and made integral with the bridge 1*a* and the bottom plate 1*b*, respectively, by driving in or adhesion in a corresponding cutout provided on the bridge 1*a* and the bottom plate 1*b*. The plates 6*a*, 6*b* are arranged so that their holes 8*a*, 8*b* are placed opposite holes 3*a*, 3*b* of the boards 2*a*, 2*b*.

Of course it is possible to make the bridge or the bottom plate from diamond, comprising a hole for receiving the pivot-shank of the second plate, forming the pivot, the first plate provided with the hole and forming the bearing, which is then an integral part of said frame.

Each pivot is formed using a second plate 7*a*, 7*b* comprising a planar element from which a cylindrical element protrudes, perpendicular to the planar element and forming a pivot-shank 9*a*, 9*b* so that there is an annular peripheral rim 10*a*, 10*b*, against which the board 2*a*, 2*b* is axially positioned, respectively, making it possible to maintain the plates 7*a*, 7*b* between the two boards 2*a* and 2*b*, and to make the second plates 7*a*, 7*b* respectively integral with the boards 2*a*, 2*b*. The plate 7*a*, 7*b* is made from diamond.

According to the invention, the pivot-shank 9*a*, 9*b* is respectively engaged in the hole 3*a*, 3*b* of the board 2*a*, 2*b* and in the hole 8*a*, 8*b* of the first plate 6*a*, 6*b*. To that end, the diameter of the pivot-shank 9*a*, 9*b* is smaller than that of the hole 8*a*, 8*b* of the plate 6*a*, 6*b* and of the hole 3*a*, 3*b* of the board 2*a*, 2*b*, respectively.

The boards 2*a* and 2*b* respectively comprise two lugs 12*a*, 12*b* in the form of two angular sectors protruding from said board. The two lugs 12*a*, 12*b*, respectively, are arranged opposite each other concentrically to the hole 3*a*, 3*b*, respectively. The lugs 12*a* and 12*b* are arranged complementarily to cooperate in pairs and make the boards 2*a* and 2*b* integral in rotation. The accumulated thickness of the two rims 10*a* and 10*b* is substantially equal to the height of the lugs 12*a* or 12*b*, so as to ensure maintenance of the plates 7*a* and 7*b* without shaking.

Figure 3:
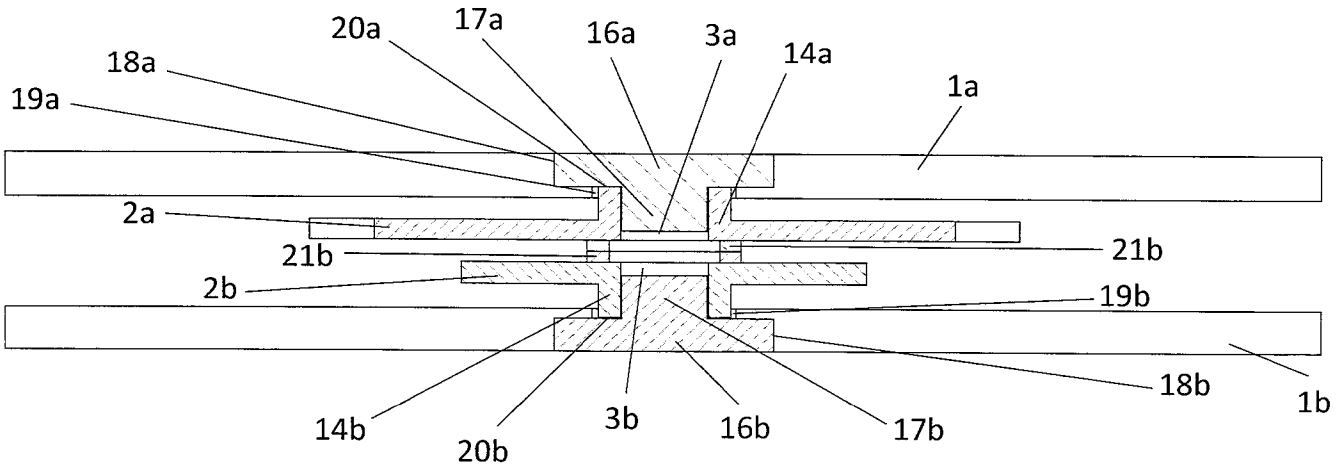
FIG. 3 is a cross-sectional view of another alternative of the invention.

FIG. 3 shows another alternative embodiment of the invention. The elements shared with the first alternative are shown with the same references. The timepiece comprises a metal frame formed by a bridge 1*a* and a bottom plate 1*b*, and a wheel having a first board 2*a* provided with a toothing and a hole 3*a*, and a second board 2*b* provided with a toothing and a hole 3*b*. In this alternative, each hole 3*a*, 3*b* is bordered by a skirt 14*a*, 14*b*, respectively, protruding towards the bridge 1*a* and the bottom plate 1*b*, respectively. The boards 2*a*, 2*b* and their collars 14*a*, 14*b* are made from diamond, for example by CVD.

The wheel is pivotably mounted on the bridge 1*a* and the bottom plate 1*b* using two pivoting members that each respectively comprise a bearing and a pivot engaged in their respective bearing.

In this alternative, the plate provided with a hole forming the bearing of the first pivoting member is merged with the board 2*a* provided with the hole 3*a* and the collar 14*a*, said plate then being integral with the wheel. Likewise, the plate provided with a hole forming the bearing of the other pivoting member is merged with the board 2*b* provided with the hole 3*b* and the collar 14*b*.

Each pivot is formed by at least one second plate 16*a*, 16*b* comprising a planar element from which a cylindrical element protrudes, perpendicular to the planar element and forming a pivot-shank 17*a*, 17*b*. As for all of the other alternatives of the invention, the second plate is never merged with the board of the wheel, such that the pivot belongs to a piece separate from the wheel. The bridge 1*a* and the bottom plate 1*b* respectively include a housing 18*a*, 18*b*, in which the planar element of the plate 16*a*, 16*b* is housed, and a cutout 19*a*, 19*b* with smaller dimensions, for the passage of the pivot-shank 17*a*, 17*b*, such that there is an annular peripheral rim 20*a*, 20*b* in which the collar 14*a*, 14*b* of the board 2*a*, 2*b* circulates, respectively. The plate 16*a*, 16*b* is made from diamond and is made integral with the bridge 1*a* and the bottom plate 1*b* respectively by driving in or by adhesion.

According to the invention, the pivot-shank 17*a*, 17*b* is respectively engaged in the hole 3*a*, 3*b* of the board 2*a*, 2*b*, such that the collar 14*a*, 14*b* is engaged in the annular peripheral rim 20*a*, 20*b*. To that end, the diameter of the pivot-shank 17*a*, 17*b* is smaller than that of the hole 3*a*, 3*b* of the board 2*a*, 2*b*, respectively.

The boards 2*a*, 2*b* are made integral in rotation using metal rings 21*a*, 21*b* provided on the perimeter of the holes 3*a* and 3*b*, respectively, and welded to each other by laser.

FIGS. 4 to 7 show another alternative embodiment of the invention. The elements shared with the first alternative are shown with the same references. The timepiece comprises a metal frame formed by a bridge 1*a* and a bottom plate 1*b*, and a wheel including a first board 2*a* provided with a toothing and a hole 3*a*, and a second board 2*b* provided with a toothing and a hole 3*b*. The boards 2*a*, 2*b* are made from diamond, for example by CVD.

The wheel is pivotably mounted on the bridge 1*a* and the bottom plate 1*b* using two pivoting members that each respectively comprises a bearing and a pivot engaged in their respective bearing.

In this alternative, the plate provided with a hole forming the bearing of the first pivoting member is merged with the board 2*a* provided with the hole 3*a*, said plate then being integral with the wheel. Likewise, the plate provided with a hole forming the bearing of the other pivoting member is merged with the board 2*b* provided with the hole 3*b*.

Each pivot is formed using a second plate 25*a*, 25*b*, comprising a planar element from which a cylindrical element protrudes, perpendicular to the planar element and forming a pivot-shank 26*a*, 26*b*, such that an annular peripheral rim 27*a*, 27*b* exists, in which the board 2*a*, 2*b* circulates, respectively.

Furthermore, in this alternative, a shaft 28 is provided mounted passing through the second plates 25*a* and 25*b* and the pivot-shanks 26*a* and 26*b*, the shaft 28 emerging from each plate 25*a*, 25*b* on the side opposite the pivot-shank 26*a*, 26*b* to be housed in a corresponding housing provided on the bridge 1*a* and the bottom plate 1*b*, respectively. The rod 28 is made integral with the bottom plate 1*b* by driving in or adhesion of one of its ends in the bottom plate 1*b*, the other end of the shaft 28 being engaged free in the bridge 1*a*, thereby allowing the assembly to be disassembled. Of course the shaft 28 can conversely be driven into the bridge, and left free in the bottom plate.

Figure 7:
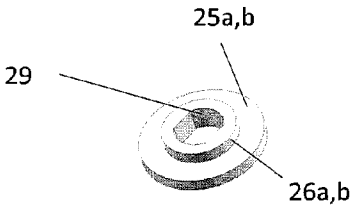
FIG. 7 is a perspective view of the plate forming a pivot used in the alternative of FIG. 4.
Figure 5:
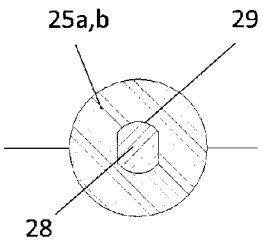
FIG. 5 is a detailed cross-sectional view showing the plate forming the pivot and the shaft, according to the alternative of FIG. 4.
Figure 4:
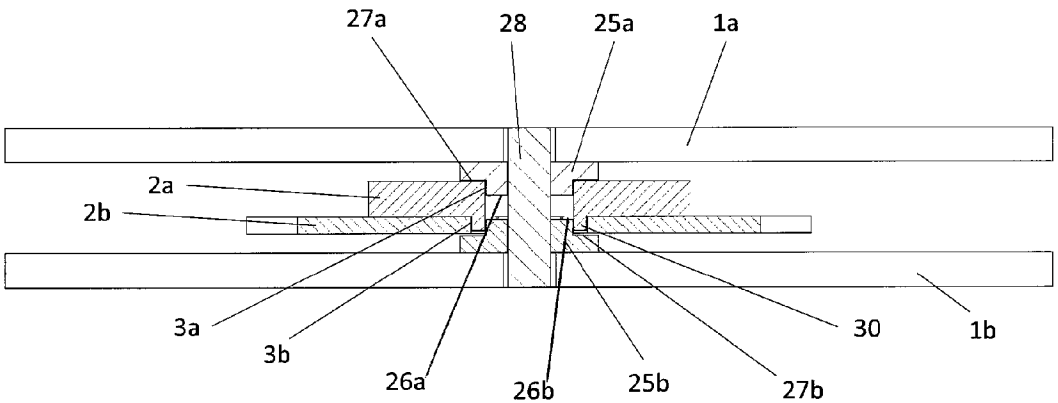
FIG. 4 is a cross-sectional view of another alternative of the invention.

As shown in FIGS. 5 and 7, the second plates 25*a*, 25*b* and the pivot-shanks 26*a*, 26*b* have a circular central orifice 29 with two flats, the shaft 28 having a cylindrical section with two flats, with a shape complementary to the central orifice 29, so as to angularly maintain the plates 25*a*, 25*b* relative to the shaft 28, and thereby make them integral with said shaft 28, and therefore the bridge 1*a* and the bottom plate 1*b*. The plate 25*a*, 25*b* is made from diamond. The shaft 28 is made from a material able to have a plastic deformation to make it possible to slide and drive in the plates 25*a*, 25*b* on the shaft 28. The shaft 28 is for example made from steel.

According to the invention, the pivot-shank 26*a*, 26*b* is respectively engaged in the hole 3*a*, 3*b* of the board 2*a*, 2*b*, so that the board 2*a*, 2*b* is engaged in the annular peripheral rim 27*a*, 27*b*, respectively. To that end, the diameter of the pivot-shank 26*a*, 26*b* is smaller than that of the hole 3*a*, 3*b* of the board 2*a*, 2*b*, respectively.

Figure 6:
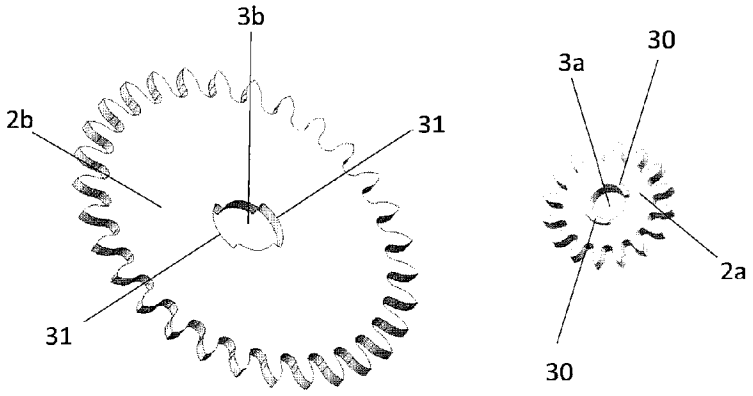
FIG. 6 is a perspective view of the wheel used in the alternative of FIG. 4.

As shown in FIG. 6, the board 2*a* includes two lugs 30 in the form of two angular sectors protruding from said plate, and arranged opposite each other concentrically to the hole 3*a*. The hole 3*b* of the board 2*b* includes two notches 31, with a shape complementary to that of the lugs 30, and arranged opposite each other concentrically to the hole 3*b*. The lugs 30 are engaged in the notches 31 to make the boards 2*a* and 2*b* integral in rotation.

Of course the boards 2*a* and 2*b* can be made integral in rotation by replacing the notches 31 with two lugs complementary to the lugs 30, like those shown in FIG. 2. The lugs can also be replaced by metal rings like those used for the alternative of FIG. 3.

Figure 8:
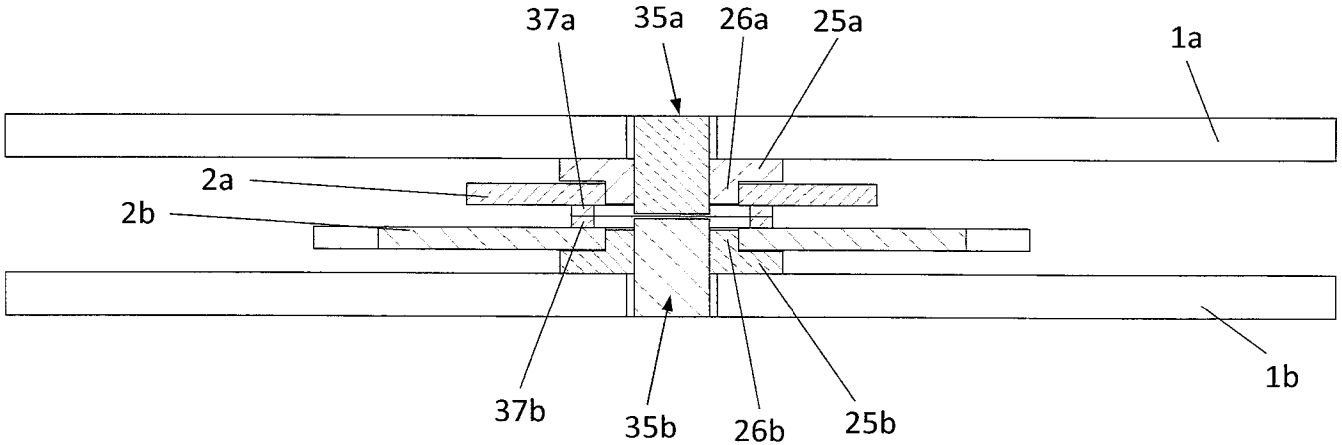
FIG. 8 is a cross-sectional view of another alternative of the invention.
Figure 9:
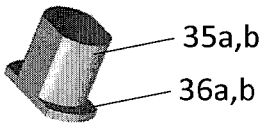
FIG. 9 is a perspective view of a shaft used in the alternative of FIG. 8.

FIGS. 8 and 9 show another alternative of the invention, close to the alternative shown in FIGS. 4 to 7, the shared elements being shown with the same references.

In this alternative, a shaft 35*a* is mounted passing through the second plate 25*a* and in the pivot-shank 26*a*, the shaft 35*a* emerging on the side opposite the pivot-shank 26*a* to be housed in a corresponding housing provided on the bridge 1*a*. The shaft 35*a* is made integral with the bridge 1*a* by driving in or adhering the end thereof in the bridge 1*a*. Likewise, a shaft 35*b* is mounted passing through the second plate 25*b* and in the pivot-shank 26*b*, the shaft 35*b* emerging in the side opposite the pivot-shank 26*b* to be housed in a corresponding housing provided on the bottom plate 1*b*. The shaft 35*b* is made integral with the bottom plate 1*b* by driving in or adhering its end in said bottom plate 1*b*.

The plate 25*a*, 25*b* to form the pivot is the same as that shown in FIG. 7. As shown in FIG. 9, each shaft 35*a*, 35*b* has a cylindrical section with two flats, with a shape complementary to the central orifice 29 of the plate 25*a*, 25*b*, so as to make said plate 25*a*, 25*b* integral with the shaft 35*a*, 35*b*, respectively, and therefore the bridge 1*a* and the bottom plate 1*b*, respectively. Furthermore, each shaft 35*a*, 35*b* has a planar base 36*a*, 36*b* perpendicular to said shaft 35*a*, 35*b*, with dimensions substantially equal to those of the pivot-shank 26*a*, 26*b*. The shaft 35*a*, 35*b* is engaged in the orifice 29 of the plate 25*a*, 25*b* so that the pivot-shank 26*a*, 26 is in contact with the base 36*a*, 36*b* of the shaft 35*a*, 35*b*, respectively, so as to improve the maintenance of the plate 25*a*, 25*b*, respectively.

In the alternative shown in FIG. 8, the plates 2*a*, 2*b* are made integral in rotation using metal rings 37*a*, 37*b* like those used for the alternative of FIG. 3.

Figure 10:
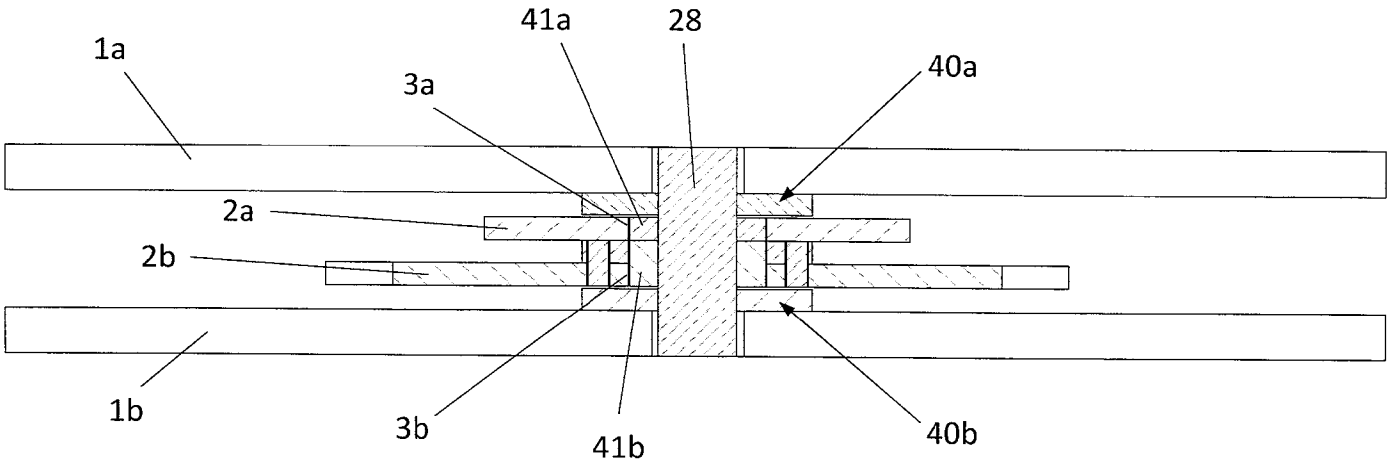
FIG. 10 is a cross-sectional view of another alternative of the invention.

FIG. 10 shows another alternative of the invention, close to the alternative shown in FIGS. 4 to 7, the shared elements being shown with the same references.

In this alternative, each pivot is formed using a second plate 40*a*, 40*b* comprising a planar element and a separate cylindrical element, perpendicular to the planar element and forming a pivot-shank 41*a*, 41*b* engaged respectively in the hole 3*a*, 3*b* of the board 2*a*, 2*b* forming the bearing.

As in the alternative shown in FIGS. 4 to 7, a shaft 28 is provided mounted through the second plates 40*a* and 40*b* and in the pivot-shanks 41*a* and 41*b*, the shaft 28 emerging from each plate 40*a*, 40*b* on the side opposite the pivot-shank 41*a*, 41*b* to be housed in a corresponding housing provided on the bridge 1*a* and the bottom plate 1*b*, respectively. The second plates 40*a*, 40*b* and the pivot-shanks 41*a*, 41*b* have a circular central orifice with two flats, the shaft 28 having a cylindrical section with two flats, the shaft 28 having a cylindrical section with two flats, with a shape complementary to the central orifice, so as to angularly maintain the plates 40*a*, 40*b* relative to the shaft 28, and to thereby make them integral with said shaft 28, and therefore the bridge 1*a* and the bottom plate 1*b*.

In the different examples provided here for information, all of the elements are made from diamond with the exception of the frame and the through-shaft. Of course the elements can be made from silicon or another suitable material, only the contact surfaces between the different elements being covered with diamond or any other material or mixture of materials having a coefficient of friction and a wear rate equivalent to those of the diamond.

The diamond has a particularly low coefficient of friction, such that it is not even necessary to lubricate. It is thus possible to ensure the pivoting of a wheel or any other piece pivotably mounted with diamond-on-diamond friction, using pieces that can easily be manufactured by CVD.

The invention claimed is :

1. A timepiece comprising a frame and a wheel pivotably mounted on said frame using at least one pivoting member that comprises a bearing and a pivot engaged in said bearing, the wheel having at least one board provided with a first hole, wherein at least the contact surfaces of the bearing and the pivot are made from at least one material intrinsically having a coefficient of friction and a wear rate equivalent to those of diamond and wherein said pivoting member comprises a first plate provided with a second hole and forming the bearing, and a second plate provided with a pivot-shank engaged in said first and second holes, and forming the pivot, said first and second plates being made integral one with the wheel, the other with the frame.

2. The timepiece according to claim 1, wherein the second plate to form said pivot comprises a planar element from which a cylindrical element protrudes forming the pivot-shank, the two elements being in a single piece.

3. The timepiece according to claim 1, wherein the second plate to form said pivot comprises a planar element and a cylindrical element forming the pivot-shank, the two elements being separate.

4. The timepiece according to claim 1, wherein the second plate comprises, on the side opposite the pivot-shank, a shank made integral with said second plate and the frame.

5. The timepiece according to claim 4, wherein said shaft is mounted passing through said second plate and in said pivot-shank.

6. The timepiece according to claim 1, wherein the board provided with the first hole and the first plate provided with the second hole are merged, said first and second holes being merged.

7. The timepiece according to claim 1, wherein said wheel includes two boards provided with a first hole and made integral in rotation, each board respectively being pivotably mounted in the frame using said pivoting member.

8. The timepiece according to claim 7, wherein said boards comprise, around their first respective hole, a metal ring.

9. The timepiece according to claim 7, wherein said boards respectively comprise complementary assembly means arranged to cooperate and make said boards integral in rotation.

10. The timepiece according to claim 7, wherein the shaft is mounted passing through the second plate and in the pivot-shank of the pivoting member of each board of said wheel.

11. The timepiece according to claim 1, wherein the material intrinsically having a low coefficient of friction and a low wear rate, making up at least the contact surfaces of the bearing and the pivot, is diamond.

* * * * *